US007032531B1

(12) United States Patent
Caples

(10) Patent No.: US 7,032,531 B1
(45) Date of Patent: Apr. 25, 2006

(54) KAYAK

(76) Inventor: Sean G. Caples, Malibu Kayaks 13138 Arctic Cir., Santa Fe Springs, CA (US) 90670

( * ) Notice: Subject to any disclaimer, the term of this patent is extended or adjusted under 35 U.S.C. 154(b) by 0 days.

(21) Appl. No.: 11/183,150

(22) Filed: Jul. 15, 2005

(51) Int. Cl.
*B63B 35/00* (2006.01)

(52) U.S. Cl. ..... 114/347

(58) Field of Classification Search ..... 114/347
See application file for complete search history.

(56) References Cited

U.S. PATENT DOCUMENTS

| | | | | |
|---|---|---|---|---|
| 4,739,720 | A | 4/1988 | Jarschke | |
| 5,460,551 | A | 10/1995 | Beres | |
| D377,473 | S | 1/1997 | Niemier | |
| 5,605,112 | A | 2/1997 | Schuman | |
| 5,964,177 | A | 10/1999 | Niemier | |
| 6,050,213 | A | 4/2000 | Stevens | |
| 6,065,421 | A | 5/2000 | Haller et al. | |
| 6,152,063 | A | 11/2000 | Niemier | |
| 6,178,912 | B1 | 1/2001 | Niemier | |
| 6,223,678 | B1 | 5/2001 | Haller et al. | |
| 6,390,013 | B1 | 5/2002 | Cornell | |
| 6,401,648 | B1 * | 6/2002 | Abbenhouse | 114/347 |
| 6,427,619 | B1 | 8/2002 | Cornell | |
| 6,581,538 | B1 | 6/2003 | Sorensen | |
| 6,681,968 | B1 | 1/2004 | Zwagerman | |
| 6,755,145 | B1 | 6/2004 | Bolebruch | |
| 6,840,190 | B1 | 1/2005 | Godek | |
| 2001/0001941 | A1 * | 5/2001 | Dust | 114/347 |
| 2004/0040870 | A1 | 3/2004 | Morrison et al. | |
| 2004/0079273 | A1 | 4/2004 | Godek | |

* cited by examiner

*Primary Examiner*—Jesus D. Sotelo
(74) *Attorney, Agent, or Firm*—Stephen J. Koundakjian; Charles W. Fallow

(57) ABSTRACT

The kayak has a cargo hold with a forward hatch and a hatch cover. A forward passenger seat may be positioned atop the hatch and may, in some embodiments, selectively replace the hatch cover. Neither the forward hatch cover nor forward passenger seat intrudes substantially into the hold. An aft passenger seat may also be provided. In other embodiments, a rounded tank, which may be used as a bait tank, is positioned forward of the operator seat. Yet other embodiments include an aft hatch that slants in respect to the upper surface of the kayak. Seat pads may be provided for the operator's seat and for the tank.

20 Claims, 6 Drawing Sheets

KAYAK

BACKGROUND OF THE INVENTION

1. Field of the Invention

This invention relates to the field of kayaks for use in water sport activities.

2. Description of Prior Art

At some time in the mists of prehistory, the Inuit discovered that a durable, lightweight, waterproof boat could be constructed from sealskins stretched tightly over a seal bone frame. Various improvements were made in these small, portable boats, over the years. One of the best known is version in which the user, dressed in warm, waterproof clothing, slides himself into the interior of the boat through a small opening at the top, forming a watertight seal between his clothing and the opening, in a sense becoming one with the boat. With half of the combined weight of his body, clothing and the boat below the waterline, he can easily roll the boat through a 360° circuit and emerge upright, after having been submerged in the icy waters for a very short time. While he might, at worst, experience a mouthful of salt water, his boat cannot be permanently capsized, and he will not drown, even if he, like many Inuit, cannot swim.

These skin boats were called qayaq in the Inuit language, from which we derive the word kayak. Sports enthusiasts—and ordinary people who just enjoy being in the sun and cruising along in the water—have discovered the utility and simplicity of kayaks. They are now popular everywhere that aquatic activities are practiced. Naturally, man's ingenuity continues to add refinements to the basic Inuit concept. But its fundamental features have remained the same.

For example, while many kayaks, following the original qayaq design, are rigid, others are inflatable. One of many such designs is shown and described in U.S. Pat. No. 6,065,421, which is fully incorporated herein by reference. Such a design has the advantage of being collapsible, for easy storage and transportation. However, like all collapsible devices, some means must be provided to re-inflate or otherwise re-assemble such a kayak for use. This may prove difficult, or at least inconvenient. Accordingly, most sporting kayaks, today, are of rigid construction, which not only obviates the need for re-assembly at the location of usage, but also provides increased structural integrity. In that respect, among others, the Inuit were correct.

Those who enjoy kayaking also seek to augment their experience by integrating the basic sport of kayaking with other activities. In a sense, they are simply following the original Inuit concept. Just as the Inuit, modern kayakers also use them for fishing, for example. The problem has been in what to do with the fishing gear. Of course, it can be strapped to the top of the kayak, in transverse orientation, as shown in U.S. Pat. No. 5,996,527, which is fully incorporated herein by reference. Indeed, even the paddle can be transversely mounted, as shown in U.S. Pat. No. 6,755,145, which is likewise fully incorporated herein by reference. While there is nothing particularly wrong with transverse mounting of fishing poles or paddles, in a utilitarian sense, the overall configuration appears clumsy and awkward. After all, one of the pleasant aspects of water sports, generally, is the feeling of smoothly gliding through the water, like a fish or dolphin. These designs would appear to interfere with that aesthetic sense.

Similarly, kayakers enjoy bringing along refreshments and other items, such as beverage coolers, radios, TV sets, CD or DVD players, additional fishing gear, books . . . whatever their individual interests dictate. Many inventors have provided means to store such items in kayaks, in various ways. Exemplary are those shown and described in U.S. Pat. Nos. 4,739,720; 5,605,112; 6,050,213; and 6,840,190; and in Published U.S. patent application Ser. No. 10/280,300 (Publication No. U.S. 2004/0079273 A1)—all of these fully incorporated herein by reference. But the problem with these and the other conceptually similar designs is that the storage means are awkward, even ugly, and, perhaps even worse, seem to integrate poorly into the overall kayak design. As has been said previously, kayaking is, after all, an aesthetic experience. Bulky, projecting items detract from that sense of joining the other aquatic creatures.

A corollary problem is that of passengers. Of course, it is possible to enjoy a day in the water alone. But there are few activities that are best enjoyed alone. Man is a social creature. People need to share their fun with others. So the question arises: Where do you place your kayak passenger . . . or passengers?

U.S. Pat. No. 5,460,551 ("Beres"), which is fully incorporated herein by reference, seeks to answer that question. In that patent, hatch covers 28 and/or 30 can be removed and replaced with utility receptacles 96 and/or 98, respectively. Beres suggests that these can be used as a child's seat (see, description of his FIG. 7 and reference to element 104).

In the particular configuration chosen by Beres, whose motive power is provided by pedals operated by the driver, spinning a propeller at the rear extremity of a drive shaft, there is little space within the kayak for storage. Because of the manner in which the kayak is driven, it is necessary for the driver to sit within the kayak, with legs essentially extended, or at least bent with knees upward. In practical reality, the design of such a kayak would almost necessitate there being a relatively long distance between the back of the seat 22 and the pedals 10, so that the driver can provide strong thrust without cramping his or her legs. This would mean that the forward utility receptacle 96 would have to be quite shallow, or otherwise near the forward end of the kayak. This, in turn, means that if a child's seat were installed in one of the spaces 58 left by a removed utility receptacle, it would most like have to be the aft one. But this would mean that the driver could not constantly monitor the activities of the child passenger, who would probably be quite small, due to the apparently small size of the available seating. The fact that the drive shaft is in the aft portion of the kayak further contributes to the small size of the seat.

Furthermore, since the Beres utility receptacles fit through large, horizontal openings in the top of his kayak and extend far downward into the space 58, there would be little room for anything else to be stored in the interior of his kayak, even if ordinary paddles were used instead of the peddle mechanism taught there. Where, for example, would the fishing pole and other fishing gear, or radio, or TV set, or beverage cooler be stored? In the Beres design, a few small things might be storable in one or both of the utility receptacles, but certainly nothing very long, such as a fishing pole or extra paddle. Beres' large, horizontal hatches also reduce the structural integrity of the kayak, necessitating structural reinforcement or considerable risk of collapse.

More efficient kayak designs have recently been developed, with increased interior space usable as a storage hold. In such designs, a superficial hatch cover may be provided to seal off hatch access to the hold to prevent water intrusion into the hold. While some of these designs may provide increased storage space, none provides easy access for storage and retrieval of long items, such as fishing poles. Furthermore, none of these designs provides passenger seating at or near a forward hatch that does not materially reduce the storage volume of the hold.

Additionally, no kayak has been provided with a secured or integral, conveniently-shaped bait tank, with a cover upon which the operator may sit while fishing, where adequate means is provided to direct overflow water to one or more scupper drains for discharge.

BRIEF SUMMARY OF THE INVENTION

The invention is a buoyant, substantially waterproof kayak in which the operator sits atop or partially within the kayak, with perhaps the lower legs extending into a forward recess in the top of the vehicle. The kayak is provided with a hold for storage even of relatively large and long items. Scupper drains may be provided, through which water entering the upper external portion of the kayak may drain into the ambient. A forward hatch is provided for access to the storage hold, with a watertight forward hatch cover. In some embodiments, an aft hatch is provided, with a watertight aft hatch cover. In the latter embodiments, the aft hatch plane is substantially angled in respect to the upper surface of the kayak, so that long items may easily be inserted forward into the hold from the aft hatch. Near the forward hatch may be a forward passenger seat, which may be incorporated into the forward hatch cover or may replace it as a separate element. In embodiments where the forward passenger seat is a separate element, it may be attached to the kayak by the same attachment mechanism as the forward hatch cover, and be likewise secured to the kayak body to provide a waterproof seal. Like the forward hatch cover, such a separate forward passenger seat does not extend into the body of the kayak, and thus does not materially decrease the storage volume. A second passenger seat may be provided aft of the operator, e.g., by molding a seat-shaped indentation into the upper surface of the kayak. In further embodiments, a rounded tank is secured to the kayak, e.g., by molding it centrally, forward of the operator seat. The tank may be used as a bait tank or perhaps as a beverage cooler. If such a tank is provided, a fishing seat may be cinched down atop the tank cover or adhesively attached atop the tank cover. While fishing, the operator can sit on the tank cover or fishing seat transversely to the axis of the kayak, with the feet dangling off one side of the kayak. Overflow means are provided to direct any tank contents that might splash out of the tank into one or more scupper drains for drainage away from the kayak.

Other aspects of the invention will be seen in reference to the Drawing and the ensuing discussion of the preferred embodiments in reference thereto.

DETAILED DESCRIPTION OF THE PREFERRED EMBODIMENTS

Figure 1:
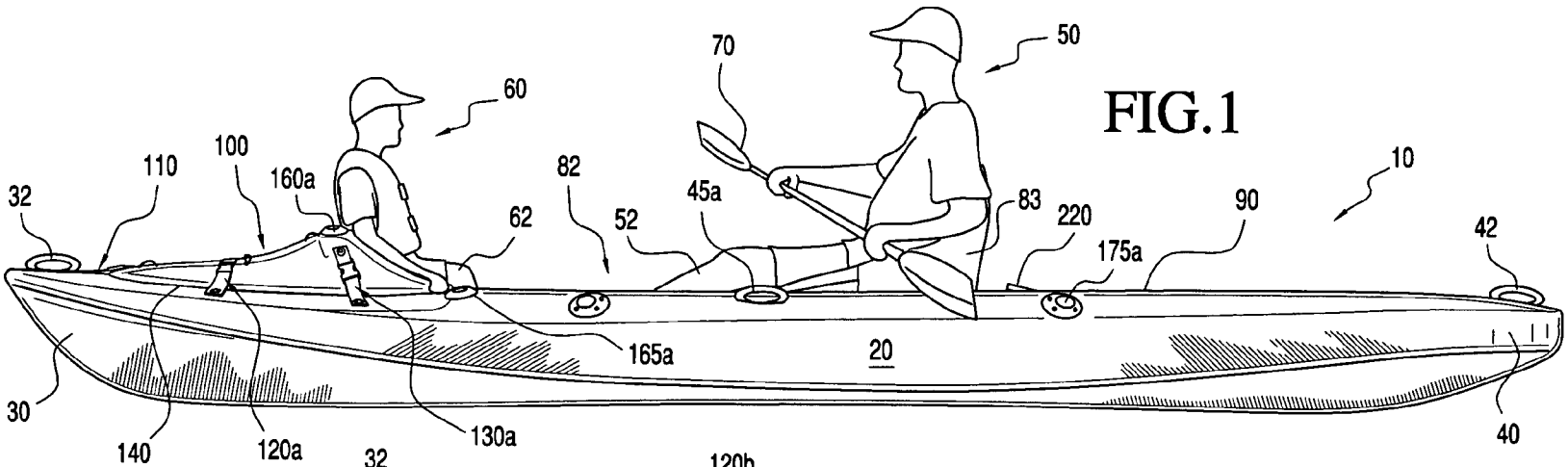
FIG. 1 is a side elevation view of a kayak according to the preferred embodiment.

Referring now to FIG. 1, the kayak 10 of the preferred embodiment of the present invention comprises a hull 20 with a forward portion 30 and aft portion 40. The hull may be constructed of any convenient material that is lightweight, structurally sound and easily formed as desired. I have found that polyethylene provides sufficient strength, and is also inexpensive and easily molded. But there are doubtless other materials that could be substituted, such as other plastics or fiberglass. Those of ordinary skill in kayak building and molding can doubtless apply their expertise to this task, without departing from the essential features and scope of the invention.

Figure 9:
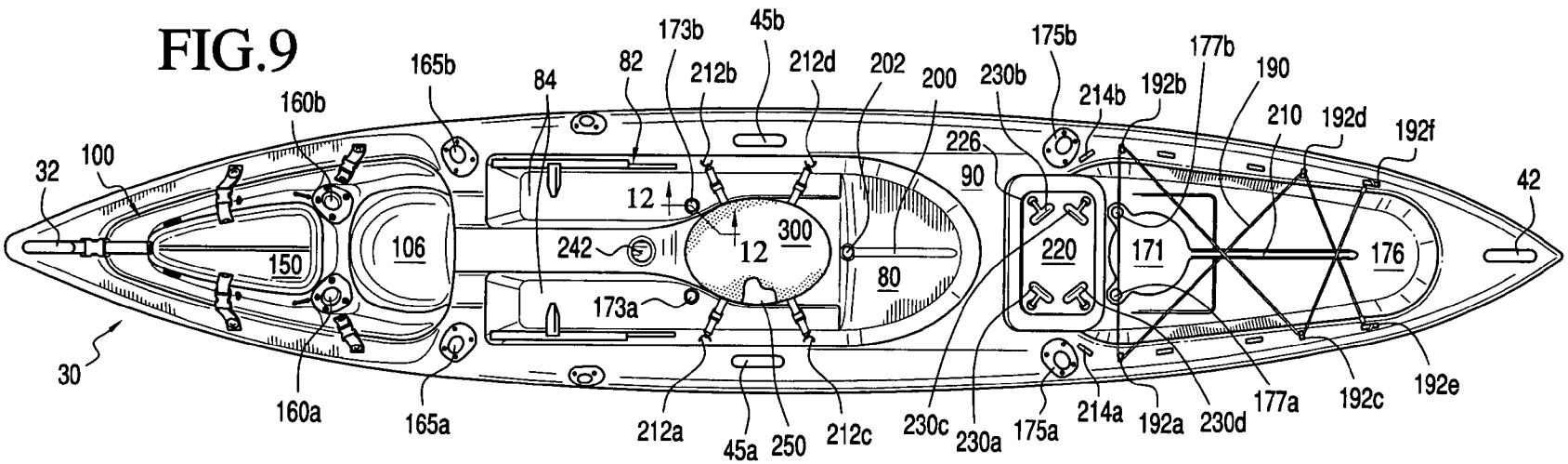
FIG. 9 is a plan view of the kayak in the embodiment shown in FIG. 8.

As shown, e.g., in FIG. 9, the kayak is provided with a forward carrying handle 32, and aft carrying handle 42, a left center carrying handle 45*a* and a right carrying handle 45*b*.

In the embodiment shown, e.g., in FIG. 1, the operator 50 and forward passenger 60 are seated facing one another, while the operator propels the kayak 10 by means of a paddle 70. It will be noted, from FIG. 1, that the operator is seated in an operator seat 80 (see, e.g., FIG. 9), which, in the preferred embodiment, is the stepped-up rearward extension of a forward recess 82 integrally molded into the top 90 of the kayak 10 itself. The particular shape of the operator seat and of the forward recess in general are not precisely shown, as this overall element of the kayak can be configured as desired, well within the basic concept and scope of this invention. However, the operator seat pad 83 is shown in position in, e.g., FIGS. 1, 8 and 11, as it would be in embodiments where such a pad is provided. In such embodiments, the operator seat pad may be attached to the kayak, in position, by clipping the outer end of left operator seat pad strap 183*a* to one of the left forward seat loops 212 *a* or 212 *c*, and by clipping the outer end of right operator seat pad strap 183*b* to one of the right forward seat loops 212 *b* or 212*d*. The back of the operator seat pad may likewise be connected, by straps (not shown) to left rear seat back loop 214*a* and right rear seat back loop 214*b*. The actual connection means is left to the practitioner's choice, although it could be an ordinary clip, as shown, e.g., in FIG. 11, or a toggle clip, as almost universally used to connect a leash to a dog's collar. When not in use, the operator seat pad may be stored in the hold.

The operator's legs 52 may extend into the forward portion 84 of the forward recess 82 (see, e.g., FIG. 9). This forward portion may be divided, as shown, into two separate sub-portions, or may be a single recessed space. However, if divided, as shown, the resulting kayak structure may be more rigid and structurally sound.

Figure 2:
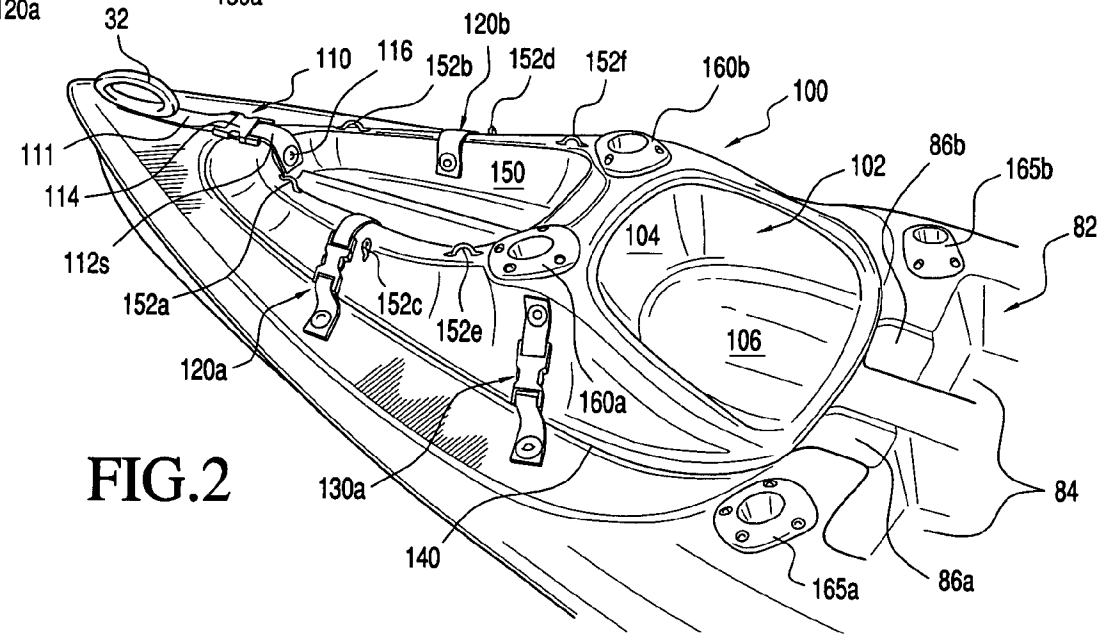
FIG. 2 is a perspective view of the forward portion of the kayak of FIG. 1, showing details of the seat in which the child shown in FIG. 1 is seated.

The forward passenger 60 sits in the forward passenger seat 100. Referring to FIG. 2, the forward passenger sits in the forward passenger space 102 in the forward passenger seat, comprising a forward passenger seat back 104 and forward passenger hip support 106. The forward passenger's legs 62 may also be extended into the forward portion 84 of the forward recess 82, or the feet may be positioned into the forward passenger foot stops 86*a* and 86*b*.

The forward passenger seat 100 is secured to the kayak 10 by means of a forward strap 110, comprising a forward strap kayak segment 111 and a forward strap seat segment 112*s*. The forward strap kayak segment and forward strap seat segment are connected by means of a snap buckle 114, as described below. The forward strap seat segment is secured to the forward passenger seat 100 preferably by means of a forward seat rivet 116. Other means of attachment are doubtless possible. However, it will be understood by those or ordinary skill in the art that all means of attachment utilized in the kayak according to the present invention must be sealed to prevent water intrusion. This can be done in any conventional way, and need not be described in detail.

Two pairs of additional securing straps are used to provide secure, waterproof attachment of the forward passenger seat 100 to the kayak 10. As shown, e.g., in FIG. 2, the second seat straps 120*a* and 120*b* are located aft of the forward strap 110. It can be seen from FIG. 2 and other figures in the Drawing, that these are constructed and secured similarly to the forward strap 110. Therefore, since there is nothing novel in these configurations, which are well within the level of ordinary skill in the art, no specific details will be given. Suffice to say that all seat straps must cause the forward passenger seat to be secured firmly to the kayak, providing a waterproof seal (see, below), and be detachable. The third seat straps 130*a* and 130*b* are positioned aft of the second seat straps 120*a* and 120*b* and are constructed and secured similarly to the latter. By properly positioning these three sets of straps, 110, 120 and 130, a tight, waterproof seal may be provided at or near the periphery 140 of the junction between the passenger seat 100 and kayak 10.

Within the top of the forward passenger seat 100, forward of the forward passenger space 102, an external forward storage space 150 is provided. Articles may be secured into this storage space by means of ropes or webbing (not shown), which may be strung through retaining loops 152*a*, 152*b*, 152*c*, 152*d*, 152*d* and 152*f*. Of course, a flexible, perhaps waterproof, covering could alternatively or additionally be used, with its corners clipped or otherwise conveniently attached to these retaining loops.

Forward passenger fishing pole retainers 160*a* and 160*b* may also be provided in the passenger seat 100, if desired. There is nothing particularly novel about these forward passenger seat fishing pole retainers. Therefore, they will not be described in detail, except to show right aft fishing pole retainer 175*b* in FIG. 10, where it is seen to comprise an essentially cylindrical holding portion 179 with a stopped lower end 181. Likewise, the pair of forward center fishing pole retainers 165*a* and 165*b* will not be described in detail, except as shown in the Drawing (see, e.g., aft fishing pole retainers 175*a* and 175*b* in FIG. 9). These are entirely conventional and, like the passenger seat fishing pole retainers, are inserted into recesses provided in the top 90 of the kayak, and secured to the kayak by means of some convenient secure, waterproof junction, appropriate to the type of material selected for construction of the kayak 10.

Figure 6:
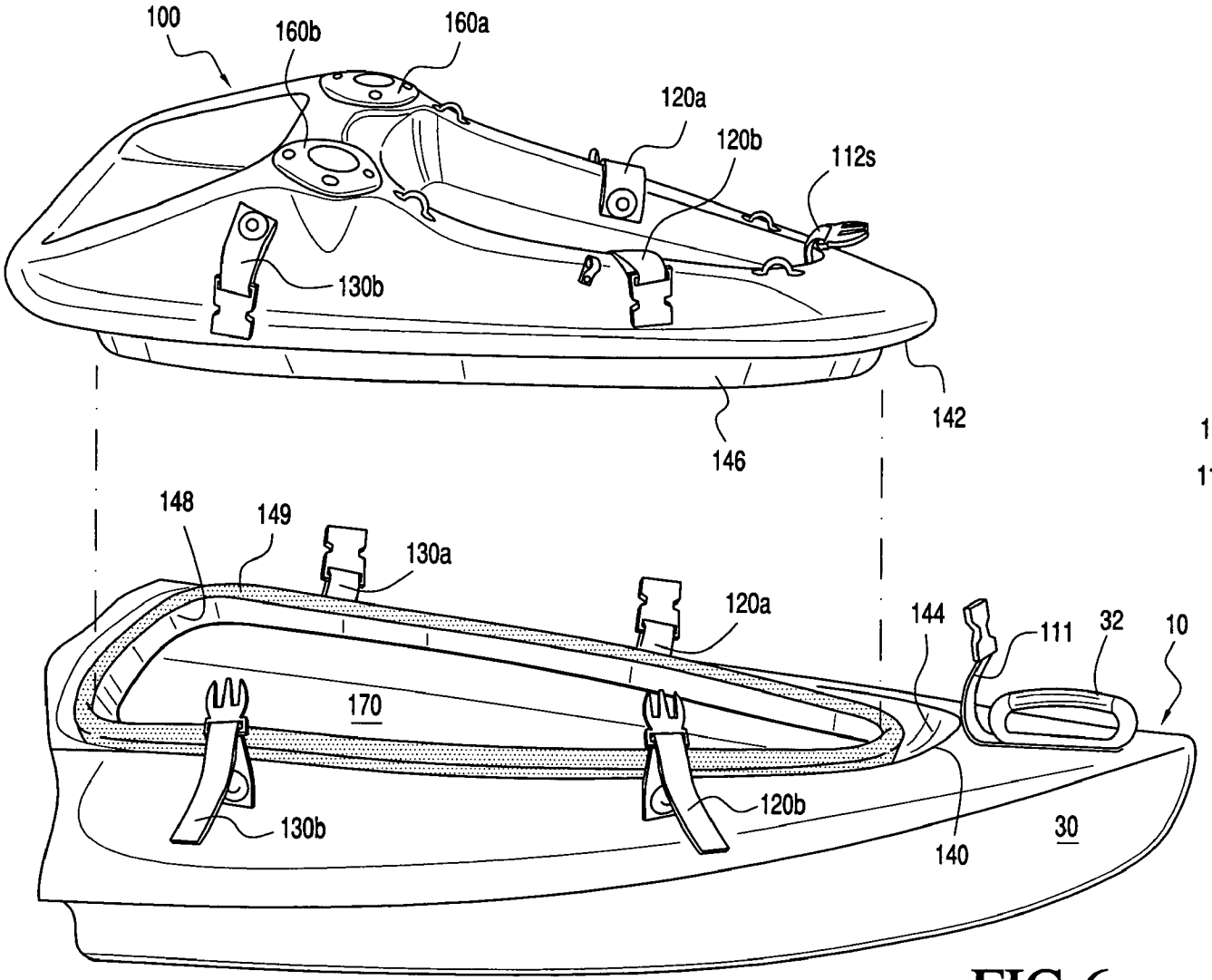
FIG. 6 is an exploded perspective view of the forward portion of the kayak shown in FIG. 1, with the seat shown in FIG. 4 being removed.

Referring to FIG. 6, it can be seen that the forward passenger seat 100 is removed from the kayak 10 by disconnecting the forward strap kayak segment 111 from the forward strap seat segment 112*s*, and similarly disconnecting the second seat straps 120*a* and 120*b* and the third seat straps 130*a* and 130*b*, and lifting it out. It is secured to the kayak by connecting these five straps.

Figure 5:
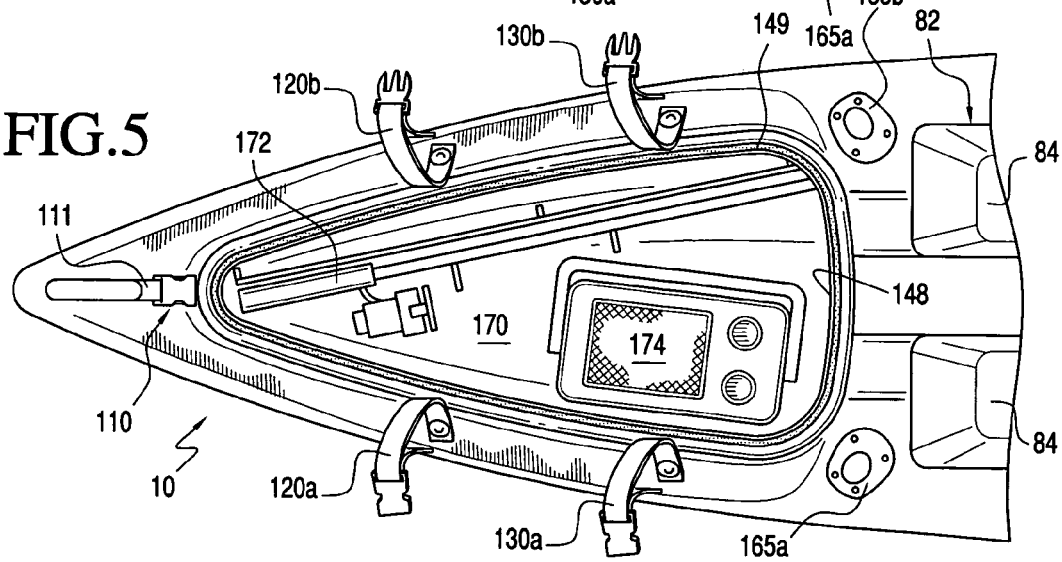
FIG. 5 is a plan view of the forward portion of the kayak shown in FIGS. 1 to 4, without a hatch cover, as shown in FIG. 3, or seat, as shown in FIG. 4, in position.

When secured to the kayak 10, the forward passenger seat 100 is sealed tightly and in waterproof fashion. To accomplish this, the entire lower bearing surface 142 of the forward passenger seat is brought into firm contact with the forward seat reception portion 144 of the top 90 of the kayak, near the periphery 140, while the forward seat insertion plug 146 is slid downward along the forward cargo hatch wall 148. It can easily be seen and appreciated that the various contacting elements of the passenger seat and kayak top are dimensioned for a close fit. Inserting the forward passenger seat into the kayak in this manner brings the lower bearing portion of the forward passenger seat into firm contact with the cargo hold O-ring 149. When all five of the straps 110, 120 and 130 are connected—having been previously adjusted for proper relative length in a conventional manner—a tight, waterproof seal is provided between the forward passenger seat and the kayak, preventing seepage of water into the cargo hold 170. See, FIG. 5. This protects the contents of the hold, e.g., a fishing pole 172, a radio (for entertainment or navigation) 174 or any other contents, from water damage.

Figure 3:
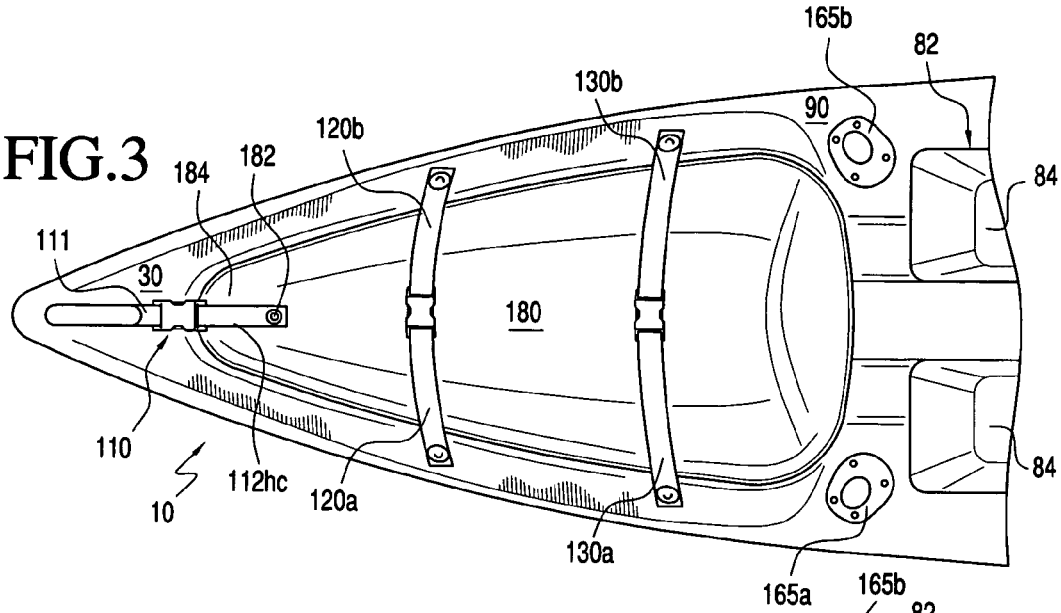
FIG. 3 is a plan view of the forward portion of the kayak shown in FIG. 1, with an attached forward hatch cover that may be replaced by the seat shown in FIGS. 1 and 2.

If it is not desired to accommodate a passenger, the forward hatch cover 180 can replace the forward passenger seat 100, as shown in FIG. 3. When a passenger accompanies the operator, the forward hatch cover can be stored in the cargo hold 170. The forward hatch cover is secured to the kayak in the same manner as the forward passenger seat, and all corresponding connections and positioning are identical, with the same effect. Thus, the lower bearing surfaces of the forward hatch cover are not shown, as they merely duplicate those of the forward passenger seat, as shown.

For example, the forward passenger seat 100 and the forward hatch cover 180 are provided with insertion plugs 146, so that positioning, support and seal are virtually identical regardless of which device covers the cargo hold 170 at that position. It will be noted, in particular, that neither the forward passenger seat insertion plug nor forward hatch cover insertion plug projects materially into the cargo hold, itself. Either device need project only far enough into the top 90 of the kayak to form a secure bearing surface with the cargo hatch wall 148. Thus, if this downward projection is kept to a minimum, as in the preferred embodiment of the invention, none, or virtually none, of the volume of the cargo hold will be used by the forward passenger seat or forward hatch cover. This preservation of maximum cargo hold volume is an important feature of the present invention.

Figure 7:
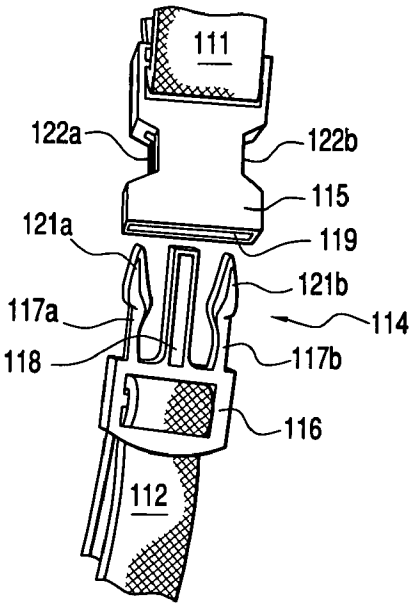
FIG. 7 is a detailed view of a snap buckle by which the hatch cover of FIG. 3 or seat of FIG. 4 may be attached to the kayak shown in FIG. 1.

While the connectors incorporated into the straps can be of many types or configurations, the presently most inexpensive yet effective type of connector for the present purposes appears to be a familiar snap buckle 114, as shown, e.g., in FIG. 7. Assuming that the strap there illustrated is a forward strap 110—it could equally be any of the straps—the snap buckle there illustrated would connect the forward strap kayak segment 111 with the forward strap seat segment 112*s*. As will be easily understood, due to the widespread use of snap buckles, the male portion 116 of the snap buckle is inserted into the female portion 115. When this occurs, the outer tines 117*a* and 117*b* are forced toward the center tine 118 when the male portion is inserted into the opening 119 of the female portion. These outer tines snap back to expanded position when further insertion brings their barbs 121*a* and 121*b*, respectively, into the cutaways 122*a* and 122*b*, respectively, of the female portion 115. Once there, the male portion is held securely within the female portion.

Certainly other connector types could be used, and even Velcro® might be used. However, it is believed that snap buckles 114, as shown, provide the best, cost effective means of securing the passenger seat 100 or the forward hatch cover 180 to the kayak 10 in a secure, waterproof manner.

It will be noted that straps 110, 120 and 130 are conceptually similar, whether in reference to the forward passenger seat 100 or the forward hatch cover 180, and are intentionally shown as such in the Drawing.

Figure 4:
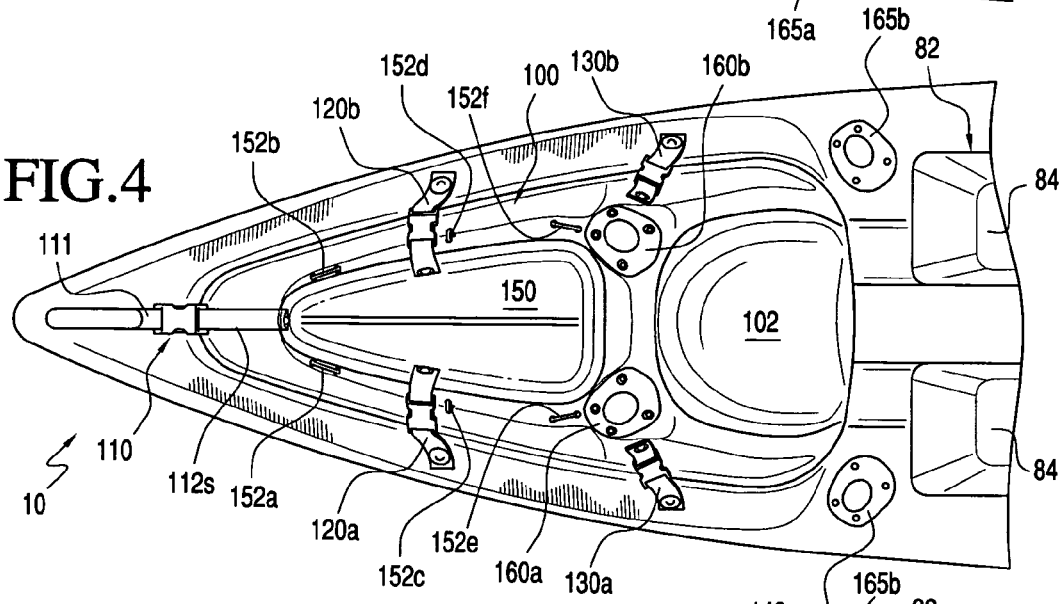
FIG. 4 is a plan view of the forward portion of the kayak shown in FIGS. 1, 2 and 3, with the seat shown in FIGS. 1 and 2 replacing the hatch cover shown in FIG. 3.

However, there is a difference in the case of snap buckles. As shown in FIG. 4, attached to the forward passenger seat 100 are segments of five straps (e.g., forward strap seat segment 112*s*), each of which terminates in a snap buckle portion connectable with a corresponding snap buckle portion at the end of a strap segment whose opposite end is attached to the upper surface 90 of the kayak hull 20. However, the forward hatch cover has only one attached strap segment 112*hc*, which is secured by a rivet 182 in the forward apex 184 of the forward hatch cover.

Thus, the snap buckle terminus of each of the five straps attached to the upper surface 90 of the hull 20 may be connected to the snap buckle terminus of the corresponding strap segment attached to the forward passenger seat. However, in the case of the forward hatch cover, as shown in FIG. 3, only the forward strap 110 joins the forward hatch cover to the hull, while the hull-attached segments of the second seat straps 120*a* and 120*b* are brought across the forward hatch cover and snapped together. Likewise, the hull-attached segments of the third seat straps 130*a* and 130*b* are brought across the forward hatch cover and snapped together.

Thus, with proper selection of the respective snap buckle termini and provision of necessary length adjustment in the segments of the second seat straps 120*a* and 120*b* and of the third seat straps 130*a* and 130*b* that attach to the upper surface 90 of the hull 20—certainly within the level of skill of the ordinary practitioner—the forward passenger seat 100 and forward hatch cover 180 may easily be interchanged, providing a secure, waterproof hatch covering in either case, even with snap buckle connections. This interchangeability, with or without snap buckle connections, promoted by selection of the type and dimensions of the various elements of the forward passenger seat and the forward hatch cover, and their respective straps, is a fundamental aspect of this invention.

There are many alternatives to the foregoing forward passenger seat design, and its suggested variations, that would be well within the level of ordinary skill in the art. For example, the forward passenger seat might be incorporated into the forward hatch cover, itself, perhaps as an indentation molded into the upper surface of the hatch cover, or as a flip-up seat that pivots into position from a recess in the upper surface of the hatch cover. Those and all designs providing a forward seat at or near the forward hatch that does not intrude substantially into the hold through the forward hatch are well within the scope of the invention as described and claimed.

Figure 8:
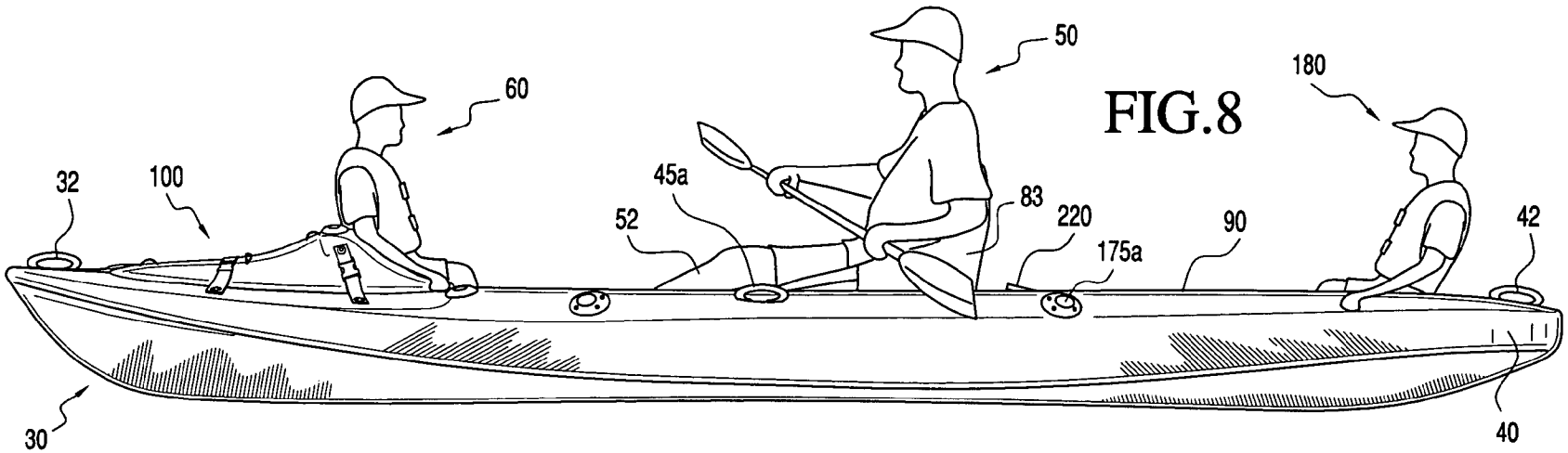
FIG. 8 is a side elevation view of an embodiment of the kayak with forward and aft seats.
Figure 10:
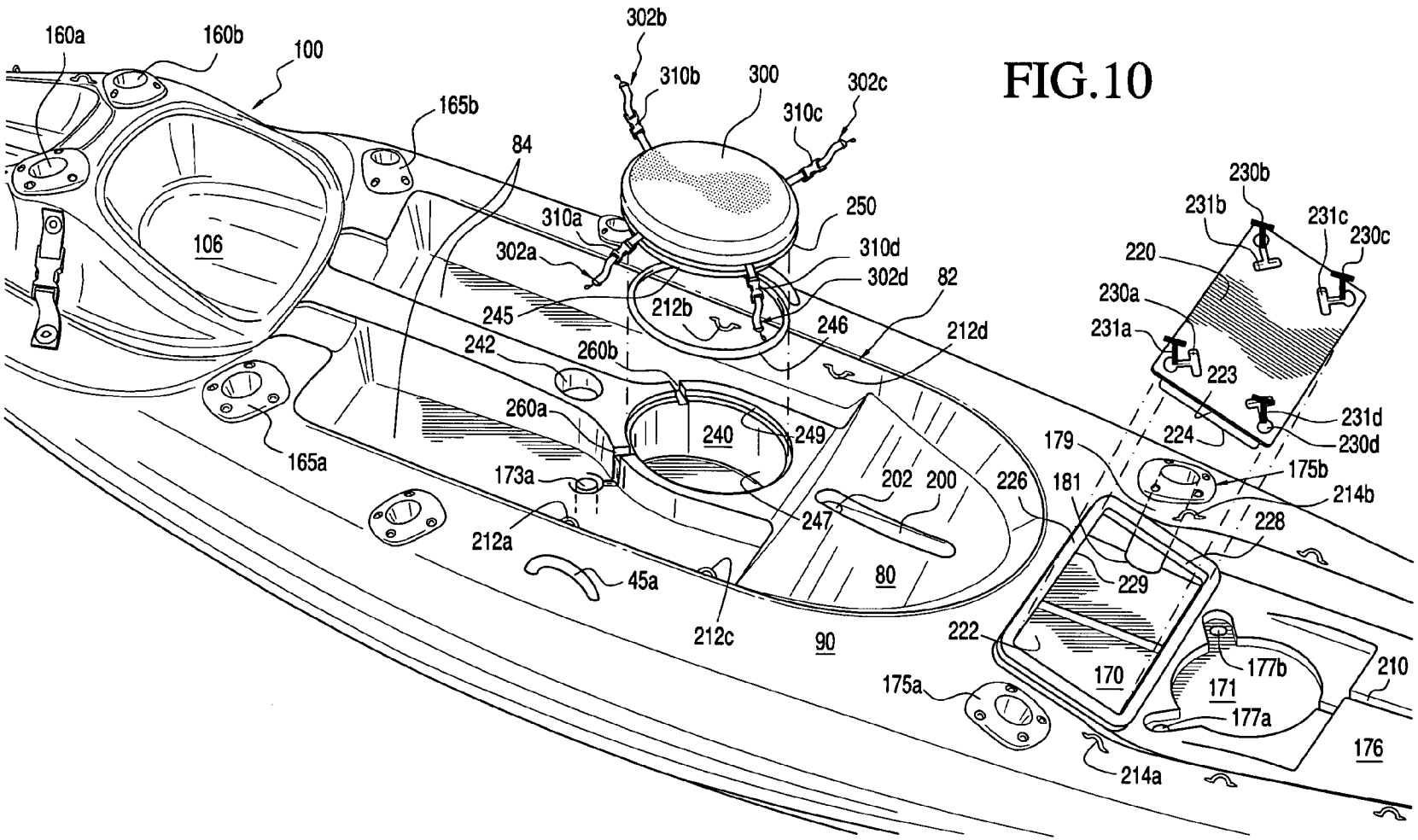
FIG. 10 is a perspective view of an embodiment of the kayak in which an integral tank and aft hatch are provided, with exploded views of the tank cover and fishing seat, and the aft hatch cover.

In other embodiments of the invention, as shown in FIGS. 8, 9 and 10, an aft seat 176 may be provided within the aft portion 40 of the kayak 10, behind the operator seat 80, to allow an aft passenger 180 to accompany the operator 50, whether or not a forward passenger seat 100 (see FIG. 10) is provided. In those embodiments that provide it, the aft seat is preferably integral with the kayak, as perhaps a recess molded into it. Forward of the aft seat, is a deeper aft drain recess 171 provided with aft scupper drains 177*a* and 177*b*, for drainage of water taken on. These aft scupper drains are thus similar in design and function to the forward scupper drains 173*a* and 173*b*. Alternatively, the aft seat could be a selectively insertable assembly corresponding to the passenger seat 100, together with its associated elements. However, for the sake of structural integrity and other reasons, such as cost-effectiveness, it is not believed to be particularly desirable to provide such a complex, removable second seat, although provision of such an element would not fall outside the scope of the invention as described and claimed.

With particular reference to FIG. 9, as in the case of the additional forward storage space 150 in the forward passenger seat 100, tie-down webbing 190 may be provided over the aft seat 176, for hold-down storage of additional articles topside when a passenger 180 is not present. This webbing could be elastic, e.g., a bungee cord, or rigid, e.g., ordinary nylon rope. Whatever the material chosen, it may be strung through holding loops 192*a*, 192*b*, 192*c*, 192*d*, 192*e* and 192*f*, or otherwise, in any convenient manner. As with the forward counterpart, a perhaps waterproof, flexible covering could alternatively or additionally be provided, with its corners clipped or otherwise conveniently attached to these holding loops. These and other alternatives, such as selection of the webbing material, if employed, are well within the level of ordinary skill in the art.

If the webbing or covering is not being exclusively used for topside storage, the aft passenger 180 could sit atop the tie-down webbing. Obviously, no passenger would be placed beneath any portion of the tie-down webbing or flexible covering, forward or aft, because if the kayak capsizes, everyone must be able to jump free of the kayak easily and without entanglement.

FIG. 9 illustrates the operator drain channel 200, which directs excess water forward into the operator scupper drain 202. Similarly, an aft drain channel 210 channels excess water into the aft drain recess 171 and thus into the aft scupper drains 177*a* and 177*b*.

Attention will now be drawn to the aft hatch cover 220 (see FIGS. 9 and 10), which, in embodiments of the invention in which an aft hatch 222 is provided, covers that aft hatch. As in the case of the forward passenger seat 100, for example, the aft hatch cover is sealed tightly and in waterproof fashion to the aft hatch. To accomplish this, the entire lower bearing surface 223 of the aft hatch cover is brought into firm contact with the aft hatch reception lip 226 of the top 90 of the kayak, while the aft hatch cover insertion plug 224 is slid downward along the aft cargo hatch wall 228. It can easily be seen that the various contacting elements of the aft hatch cover and kayak top must be dimensioned for a close fit. As in the case of, and in similar manner to, the forward passenger seat 100 and forward hatch cover 180, the attachment of the aft hatch cover is made to be waterproof. Also, because the aft hatch insertion plug does not intrude into the aft hatch beyond the bottom of the aft cargo hatch wall, no space in the hold 170 is taken by the aft hatch cover.

Attachment of the aft hatch cover 220 to the kayak 10 may be accomplished by any means that will ensure a tight, waterproof fit. In the preferred design of the present embodiment of the invention, attachment is by means of four aft hatch cover T-handles 230*a*, 230*b*, 230*c* and 230*d*, as shown in FIGS. 9 and 10. As is well known in the art, and as shown in a summary fashion in FIG. 10, each T-handle initially rests in its respective cradle 231*a*, 231*b*, 231*c* and 231*d*. To remove the aft hatch cover 220, each of the T-handles is pivoted upward and then twisted, as shown in FIG. 10. The twisting motion causes a tongue of each T-handle (not shown), originally in tight bearing relationship with the underside 229 of the reception lip 226 and thus holding the aft hatch cover firmly in place, to revolve outward from the reception portion into the open space of the hatch 222, releasing the aft hatch cover for removal.

An important aspect of this invention is the fact that the plane of the aft hatch 222 and, therefore, of the aft hatch cover 220, lies at a substantial slope in respect to the top 90 of the kayak 10. Those few prior designs that have provided an aft hatch (see, e.g., the Beres patent identified above) invariably orient them essentially parallel to the surface, so that hatch access through such hatches must be downward. However, in that case, it is very difficult to insert elongated items, such as fishing poles, into the hold from the aft portion forward. Of course, the operator may try to bend them to do so, or the aft hatch can be made so large (thus compromising structural integrity) that an item can be slid in at an angle. However, in the case of this embodiment of the present invention, where the orientation of the aft hatch and hatch cover is preferably at an angle of about 45° to the kayak top, insertion of an elongated item such as a fishing pole is trivially simple. While the advantage of such an angled aft hatch is clear with the present discussion and Drawing, no one appears ever to have introduced such an innovation. It is thus believed to be novel and unobvious.

Figure 12:
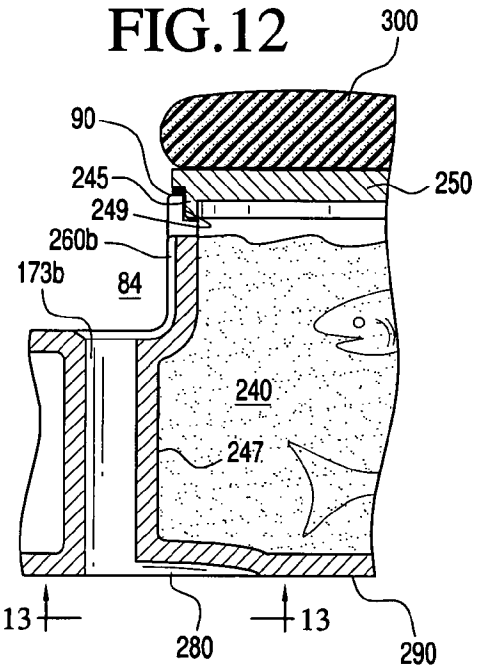
FIG. 12 is a cutaway side elevation view of the tank through Section 12—12 of FIG. 9.
Figure 11:
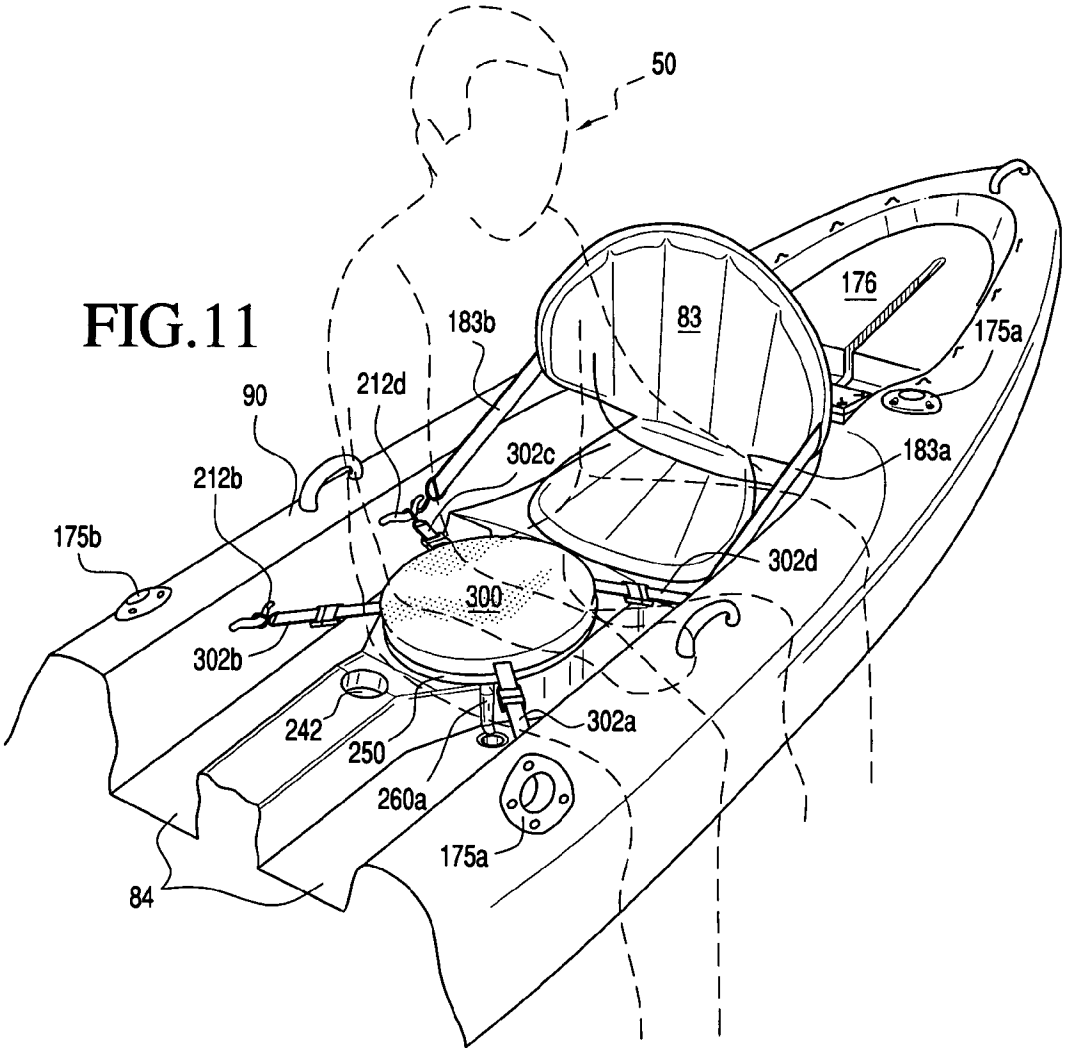
FIG. 11 is a perspective view of an embodiment having an integral tank, with the operator shown in phantom in position for fishing off the kayak.

In other embodiments of the invention, an integral tank 240 is provided, as shown, e.g., in FIG. 10. Such a tank may be used as a bait tank (as shown in FIG. 12), or perhaps filled with ice or ice water, as a beverage cooler. In the latter regard, it will be noted that the operator 50 is provided with a beverage holder 242, forward of the operator seat 80, as shown in FIGS. 9 to 11. Whatever its desired use, in the preferred design of this embodiment, the tank is molded into the kayak 10. Presumably, a cavity could be molded into the kayak at the position shown, with the tank, as a separate element securely inserted into the cavity. But no advantage is seen in such a design, although it would not depart from the scope of the invention as described and claimed.

The tank cover 250 may be secured to the tank 240 in any convenient manner, the particular means being left to the practitioner within the present teachings. In the preferred design of this embodiment of the invention, attachment is by means of four tank cover straps 302*a*, 302*b*, 302*c* and 302*d*, fastened, respectively, to forward seat loops 212*a*, 212*b*, 212*c* and 212*d*, as shown in FIG. 10. Each of these illustrated straps terminates in a connector, shown generically, by which it is fastened to its respective forward seat loop. The connector might, for example, be a toggle clip, with a snap buckle 310*a*, 310*b*, 310*c* and 310*d*, as shown, at some position in each respective strap for detachment of the tank cover from the kayak. Alternatively, for example, attachment might employ T-handles, as in the case of the aft hatch cover 220. These attachment means are merely suggestive of the many ways the tank cover might be secured to, and detached from, the kayak.

Figure 13:
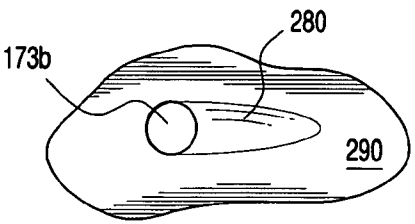
FIG. 13 is a plan detail view of the bottom of the kayak from 13—13 of FIG. 12.

Unlike the aft hatch cover 220, the forward hatch cover 180 or the forward passenger seat 100 (if provided as a separate element, interchangeable with the forward hatch cover), the tank cover 250 needn't be waterproof, as its purpose is merely to retain a level of water or other fluid within the tank 240. It is of no consequence if some of the fluid spills out into the forward recess 82 of the kayak 10 and drains through the forward scupper drains 173*a* and 173*b*. This spilled fluid, together with water that happens to be taken on, will be sucked away through the underside 280 of the kayak by the forward motion of the kayak through the water, in a manner well understood by boat designers. Essentially, the shape of the tapered indents 280, narrowing aft from the bottom of the respective scupper drain (see FIG. 13), pulls water from the scupper drains as the kayak moves forward. Gravity draws additional water from the forward recess of the kayak by gravity, to be likewise sucked away. These tapered indents are provided for all of the scupper drains in the kayak for essentially the same drainage purpose, operating similarly. In all cases, like the scupper drains themselves, they may merely be molded into the underside of the kayak.

Accordingly, an O-ring seal 246, which may be secured either to the tank top insertion plug 245 or to the interior side of the upper tank rim 249, is shown in FIG. 10, but it is not shown in FIG. 12, as use of such a sealing device, other conventional sealing means, is purely optional.

In FIGS. 9–11, the tank 240 and the tank cover 250, in plan view, are oval in configuration (perhaps with a proportionately longer aspect ratio than shown). In general, the tank and tank cover of this embodiment of the invention are of "rounded shape," i.e., in plan view they do not display angular corners. Such a rounded shape may, e.g., be circular, oval (as generally shown) or perhaps egg-shaped (i.e., an oval with unequal halves). This is an important aspect of the invention, for reasons that will quickly become apparent.

Initially, it is to be noted that prior kayak tank designs, in the few kayaks that have provided them, are square or rectangular in plan configuration, i.e., not of a rounded shape. However, since kayaking is supposed to be a pleasurable endeavor, such a shape is inconvenient for two important reasons, each of which appears to have escaped the designers of these prior tan-equipped kayaks. First, it is inconvenient for the operator to straddle a sharp-cornered square or rectangular tank that is large enough to contain a substantial quantity of live bait, for example. Secondly, it is also uncomfortable for the operator to sit on the tank, transversely with respect to the axis of the kayak, while engaged in fishing. Merely glancing, for a moment, at the tank cover shown in FIGS. 9 and 10, and considering the circumstances in which the kayak 10 might be used during a fishing expedition, the clear superiority of a rounded shape may readily be appreciated. Yet no one appears to have prospectively considered the advantages of the rounded shape, as now shown.

For further comfort, a fishing seat pad 300 may be provided to soften bodily contact with the tank cover 250 during fishing, as shown in FIG. 11. Like the operator seat pad 83, the fishing seat pad may be constructed of any material that provides a degree of comfort, yet does not rapidly deteriorate upon water contact. The exact choice of materials and other aspects of design are left to the practitioner, in view of the present teachings. Likewise, it is left to the practitioner to provide the exact attachment mechanism whereby the fishing seat pad is secured atop the tank cover. I prefer to adhesively attach the fishing seat pad atop the tank cover, so that, by means of the four tank cover straps 302*a*, 302*b*, 302*c* and 302*d*, perhaps sewn onto the fishing seat pad at appropriate points, the combined assembly may be secured to, and detached from, the kayak as a unit.

When not in use, the fishing seat pad 300 (or the combined fishing seat pad and tank cover), like the operator seat pad 83, can be stowed in the hold 170, along with whatever else the operator finds it convenient to store there, such as a spare paddle.

It is anticipated that the tank 240 would likely be used as a bait tank, as shown in FIG. 12.

In that case, a pump would be provided to circulate water into the tank for the benefit of the live bait. Since water would normally be continuously pumped into the bait tank, it would overflow the tank and drain through the tank overflow conduits 260*a* and 260*b*. The details of such a pump and its associated electrical and conduit means are not here described, as being entirely conventional.

The tank overflow conduits 260*a* and 260*b* may be described in reference to FIGS. 10, 11 and 12. Assuming the tank 240 is being used as a bait tank, as shown in FIG. 12, if water sloshes or progressively overflows from the region storing the live bait, it can exit through one of the overflow conduits into its respective scupper drain. As shown in FIG. 12, this would be left tank overflow conduit 260*a*, directing water into left forward scupper drain 173*a*. Egress from the tank is, in FIG. 12, behind the tank cover insertion plug 245 and upper tank rim 249, just beneath the kayak top 90. Obviously, to prevent the live bait from escaping, the cross-section of the overflow conduit 260*a* must be fairly small, as is shown in FIGS. 10, 11 and 12. Further details of overflow from the tank are left to the practitioner, in view of the present teachings.

The foregoing discussion is intended merely to apprise those of ordinary skill in the art of kayak design and construction as to the inventive aspects of the present invention. It is assumed that many modifications might be made by such practitioners, based on these teachings, and several possible alternatives have been suggested above, e.g., incorporation of the forward passenger seat into the forward hatch cover, itself, rather than as a separate, interchangeable structure. Certainly, the choice of construction material, overall configuration, color, decoration and other aspects of the kayak 10, which are left to the practitioner, would be well within the scope of the invention.

These and other modifications would be within the capability of the ordinary practitioner, based on these teachings, and are merely suggested as illustrating the fact that many further alternations and modifications may be made by those having ordinary skill in the art without departing from the spirit and scope of the invention. Therefore, it must be understood that the illustrated and described embodiments have been set forth only for the purpose of example and that these should not be taken as limiting the invention as defined by the claims to follow.

The words used in this Specification to describe the invention and its various embodiments are to be understood not only in the sense of their commonly defined meanings, but also to include, by special definition in this Specification, structures, materials or acts beyond the scope of the commonly defined meanings. Thus if an element can be understood in the context of this Specification as including more than one meaning, then its use in a claim must be understood as being generic to all possible meanings supported by the Specification and by the word itself.

The definitions of the words or elements of the following claims, therefore, include not only the combination of elements which are literally set forth, but all equivalent structures, materials or acts for performing substantially the same function in substantially the same way to obtain substantially the same result.

Insubstantial departures from the claimed subject matter as viewed by a person with ordinary skill in the art, now known or later devised, are expressly contemplated as being equivalently within the scope of the claims, even though not performing exactly the same function in substantially the same way to obtain substantially the same result. Therefore, substitutions now or later known to one with ordinary skill in the art will be within the scope of the defined elements. The claims are thus to be understood to include what is specifically illustrated and described above, what is conceptually equivalent, what can be obviously substituted and also what essentially incorporates the essential idea of the invention.

I claim:

1. A kayak comprising:

a. a hull;

b. an operator seat for selectively positioning an operator of the kayak;

c. a hold within said hull;

d. a forward hatch, forward of said operator seat, for exposing said hold to the ambient; and e. a first passenger seat securable to said hull in proximity with said forward hatch, wherein said first passenger seat is securable to said hull at said forward hatch to prevent a substantial quantity of water from entering said hold through said hatch when said first passenger seat is thus secured, no substantial portion of said first passenger seat inserted into said hold when said first passenger seat is secured to said hull at said forward hatch.

2. The kayak as recited in claim 1, further comprising a tank held by the kayak.

3. The kayak as recited in claim 1, further comprising:

a. a forward hatch cover to prevent a substantial quantity of water from entering said hold through said forward hatch when said forward hatch cover is positioned at said forward hatch and secured to said hull, no substantial portion of said forward hatch cover inserted into said hold when said forward hatch cover is secured to said hull; and b. forward hatch cover retention means to secure said forward hatch cover to said hull at said forward hatch, said forward hatch cover retention means comprising:

(1) first securing means attached to said forward hatch cover; and (2) second securing means attached to said hull, (3) said first securing means and said second securing means cooperable to cause said forward hatch cover to be selectively secured to said hull at said forward hatch, wherein c. said first passenger seat is selectively positionable at said forward hatch and securable to said hull instead of said forward hatch cover, no substantial portion of said first passenger seat inserted into said hold when said first passenger seat is secured to said hull, said first passenger seat comprising third securing means cooperable with said second securing means to selectively secure said first passenger seat to said hull at said forward hatch.

4. The kayak as recited in claim 1, further comprising a second passenger seat aft of said operator seat.

5. The kayak as recited in claim 4, wherein said second passenger seat is integral with the kayak.

6. The kayak as recited in claim 1, wherein said first passenger seat comprises storage means.

7. The kayak as recited in claim 1, wherein said operator seat is integral with the kayak.

8. A kayak comprising:

a. a hull;

b. an operator seat for selectively positioning an operator of the kayak;

c. a hold within said hull;

d. a hatch exposing said hold to the ambient;

e. a hatch cover to prevent a substantial quantity of water from entering into said hold through said hatch when said hatch cover is positioned at said hatch and secured to said hull, no substantial portion of said hatch cover inserted into said hold when said hatch cover is positioned at said hatch and secured to said hull;

f. hatch cover retention means to secure said hatch cover to said hull at said hatch, said hatch cover retention means comprising:

(1) first securing means attached to said hatch cover; and (2) second securing means attached to said hull, (3) said first securing means and said second securing means mutually connectable to cause said hatch cover to be selectively secured to said hull at said hatch; and g. a substantially rigid tank held by the kayak, said tank being rounded in plan configuration and positioned proximately forward of said operator seat and symmetrically in respect to the longitudinal axis of the kayak.

9. The kayak as recited in claim 8, wherein said tank is integral with the kayak.

10. The kayak as recited in claim 8, further comprising a tank cover having a similar shape as said tank in plan configuration.

11. A kayak comprising:

a. a hull;

b. an operator seat for selectively positioning an operator of the kayak;

c. a hold within said hull;

d. a hatch exposing said hold to the ambient;

e. a hatch cover to prevent a substantial quantity of water from entering into said hold through said hatch when said hatch cover is positioned at said hatch and secured to said hull, no substantial portion of said hatch cover inserted into said hold when said hatch cover is positioned at said hatch and secured to said hull;

f. hatch cover retention means to secure said hatch cover to said hull at said hatch, said hatch cover retention means comprising:

(1) first securing means attached to said hatch cover; and (2) second securing means attached to said hull, (3) said first securing means and said second securing means mutually connectable to cause said hatch cover to be selectively secured to said hull at said hatch;

g. a tank held by the kayak, said tank being rounded in plan configuration; and h. a seat pad securable to the kayak atop said tank.

12. The kayak as recited in claim 11, wherein said tank is integral with the kayak.

13. The kayak as recited in claim 11, further comprising a tank cover having a similar shape as said tank in plan configuration, wherein said seat pad is securable to said tank cover.

14. The kayak as recited in claim 13, wherein said seat pad is adhesively secured to said tank cover.

15. A kayak comprising:

a. a hull;

b. an operator seat for selectively positioning an operator of the kayak;

c. a hold within said hull;

d. an aft hatch selectively exposing said hold to the ambient, the plane of said aft hatch being at a substantial angle in respect to the floor of that portion of the hold exposed to the ambient through said aft hatch;

e. an aft hatch cover to prevent a substantial quantity of water from entering into said hold through said aft hatch when said aft hatch cover is positioned at said aft hatch and secured to said hull; and f. aft hatch cover securing means to selectively secure said aft hatch cover to said aft hatch.

16. The kayak as recited in claim 15, wherein said substantial angle is approximately 450.

17. The kayak as recited in claim 15, further comprising a forward hatch positioned forward of said aft hatch, said forward hatch selectively exposing said hold to the ambient.

18. The kayak as recited in claim 15, further comprising an aft passenger seat positioned aft of said operator seat.

19. The kayak as recited in claim 18, wherein said aft passenger seat is integral with the kayak.

20. The kayak as recited in claim 18, further including a forward passenger seat, positioned forward of said operator seat.

* * * * *